US005262011A

United States Patent [19]

Ilmarinen

[11] Patent Number: 5,262,011

[45] Date of Patent: Nov. 16, 1993

[54] PRESS SHOE WITH WEDGE SHAPED HYDROSTATIC POCKET

[75] Inventor: Antti I. Ilmarinen, Jyväskylä, Finland

[73] Assignee: Valmet-Karlstad AB, Karlstad, Sweden

[21] Appl. No.: 991,220

[22] Filed: Dec. 15, 1992

[30] Foreign Application Priority Data

Dec. 23, 1991 [SE] Sweden ..... 9103823

[51] Int. Cl.[5] ..... D21F 3/02

[52] U.S. Cl. ..... 162/358.3; 162/205; 162/361

[58] Field of Search ..... 162/358.3-358.5, 162/361, 205; 492/7

[56] References Cited

U.S. PATENT DOCUMENTS

| | | | |
|---|---|---|---|
| 4,661,206 | 4/1987 | Heitmann et al. | 162/358.3 |
| 4,917,767 | 4/1990 | Ilmarinen et al. | 162/358.3 |
| 5,084,137 | 1/1992 | Ilmarinen et al. | 162/358.3 |
| 5,110,417 | 5/1992 | Lehtonen et al. | 162/358.3 |

FOREIGN PATENT DOCUMENTS 464032 2/1991 Sweden .

*Primary Examiner*—Karen M. Hastings

*Attorney, Agent, or Firm*—Bell, Seltzer, Park & Gibson

[57] ABSTRACT

A press shoe for a shoe press with extended nip, said press shoe is of combined hydrostatic and hydrodynamic type and has a plurality of hydrostatic pressure pockets, each of which is preceded by a leading land surface and followed by a trailing land surface and into which lubricant is supplied under pressure. Each pressure pocket has a first pocket zone in which a hydrodynamic pressure shall be created and which comprises a bottom surface located at gradually decreasing depth from the concave surface portion of the press shoe seen in the direction of rotation of the belt member, said depth being zero at the trailing end of the pressure pocket. The bottom surface forms an angle $\alpha$ of from 0° to about 2° with a tangent to the concave surface portion of the press shoe at the trailing end of the pressure pocket. Further the first pocket zone is preceded by a second pocket zone comprising a plane bottom surface forming an angle $\beta$ of from 0° to about $\pm 10°$ with a plane that coincides with the bottom surface of the first pocket zone.

12 Claims, 4 Drawing Sheets

PRESS SHOE WITH WEDGE SHAPED HYDROSTATIC POCKET

FIELD AND BACKGROUND OF THE INVENTION

The present invention relates to a press shoe for a press of shoe type with extended pressure nip.

Known press shoes have hydrostatic pressure pockets the depth of which being substantially constant between their leading forward and trailing ends seen in the direction of rotation of the belt. Press shoes with this type of pressure pockets are shown, for instance, in U.S. Pat. No. 5,084,137 . With a pressure pocket shaped like this, the transition to the trailing land surface is very steep and this causes a number of problems. In order to cut out the pressure pocket the milling tool must be set in at least two different machining positions, thereby complicating manufacture of the press shoe and consequently increasing manufacture costs. During operation a hydrodynamic pressure is created within the region of the trailing land surface and the steep transition between the pressure pocket and this land surface induces the hydrodynamic pressure to increase very rapidly when it commences immediately after the pressure pocket. This in turn means that the paper web and press felts are subjected to relatively strong compression within a relatively short path of movement where this rapid increase in the hydrodynamic pressure occurs. Such a rapid compression of the press felts may at least briefly cause deterioration of their ability to absorb water from the web but, more important, desirable water flows are prevented from occurring in the web and the direction of the fibres as well as fibre density may be altered, with resultant deterioration in the quality of the paper. The problem is particularly serious at high speeds of the web and constitutes an obstacle to increase the speed. When the web is being threaded through the machine thicker sections are formed due to the web being inadvertently folded double. These thicker sections may also occur in the continuous web in the form of folds, collections of fibres or the like. Said thicker sections in the web will be displaced in the directions to the pressure pocket under the influence of the counter roll since the belt member is flexible, and they will then be affected via the belt member by the steep transition between the pressure pocket and trailing land surface. Immediately thereafter they reach the trailing land region where a very rapid increase in the hydrodynamic pressure occurs as mentioned above, with resultant compression of the web. The combination of influence from said steep transition and influence from a rapid compression within a short path of movement involves great risk of a breakage occurring in the web. Furthermore, the occurrence of thicker sections, particularly large thicker sections may damage the belt member. Also in this case the problem is particularly serious at high speeds.

SUMMARY OF THE INVENTION

The object of the present invention is to at least essentially reduce the problems described above and to provide a press shoe that is less sensitive to thicker sections in the web, enables the web to be compressed with an increasing hydrodynamic pressure over a longer path of movement of the web and is easier to manufacture.

The present invention relates to a press shoe for a press of shoe type with extended pressure nip, said press comprising (a) a continuous, rotatable, liquid-impermeable, flexible belt member;

(b) a stationary, non-rotatable support beam extending axially through said endless belt member;

(c) said press shoe being adjustably supported by said support beam and having a concave surface portion;

(d) hydraulic means to press said concave surface portion of the press shoe against said belt member so that the belt member and a counter roll together form an extended nip in the direction of rotation of the belt member;

(e) means for the supply of a liquid lubricant to a surface of the press shoe being in close contact with the belt member;

(f) said press shoe having one or more hydrostatic pressure pockets, each of which is preceded and followed by a leading land surface and a trailing land surface, respectively;

(g) said means for the supply of lubricant comprising a channel opening into said hydrostatic pressure pocket in order to supply lubricant under pressure into the hydrostatic pressure pocket;

(h) said land surfaces having a dimension in the direction of rotation of the belt member that is sufficient for said press shoe to be of combined hydrostatic and hydrodynamic type;

(i) said pressure pocket having a first pocket zone in which a hydrodynamic pressure shall be created and which comprises a plane bottom surface located at gradually decreasing depth from said concave surface portion of the press shoe seen in the direction of rotation of said belt member, said depth being zero at the trailing end of said pressure pocket, said plane bottom surface forming an angle $\alpha$ of from 0° to about 2° with a tangent to said concave surface portion of the press shoe at the trailing end of the pressure pocket; and (j) said first pocket zone being preceded by a second pocket zone comprising a plane bottom surface forming an angle $\beta$ of from 0° to about $\pm 10°$ with a plane that coincides with said bottom surface of the first pocket zone.

The invention is described hereinafter in more detail with reference to the accompanying drawings.

DESCRIPTION OF PREFERRED EMBODIMENTS

Figure 1:
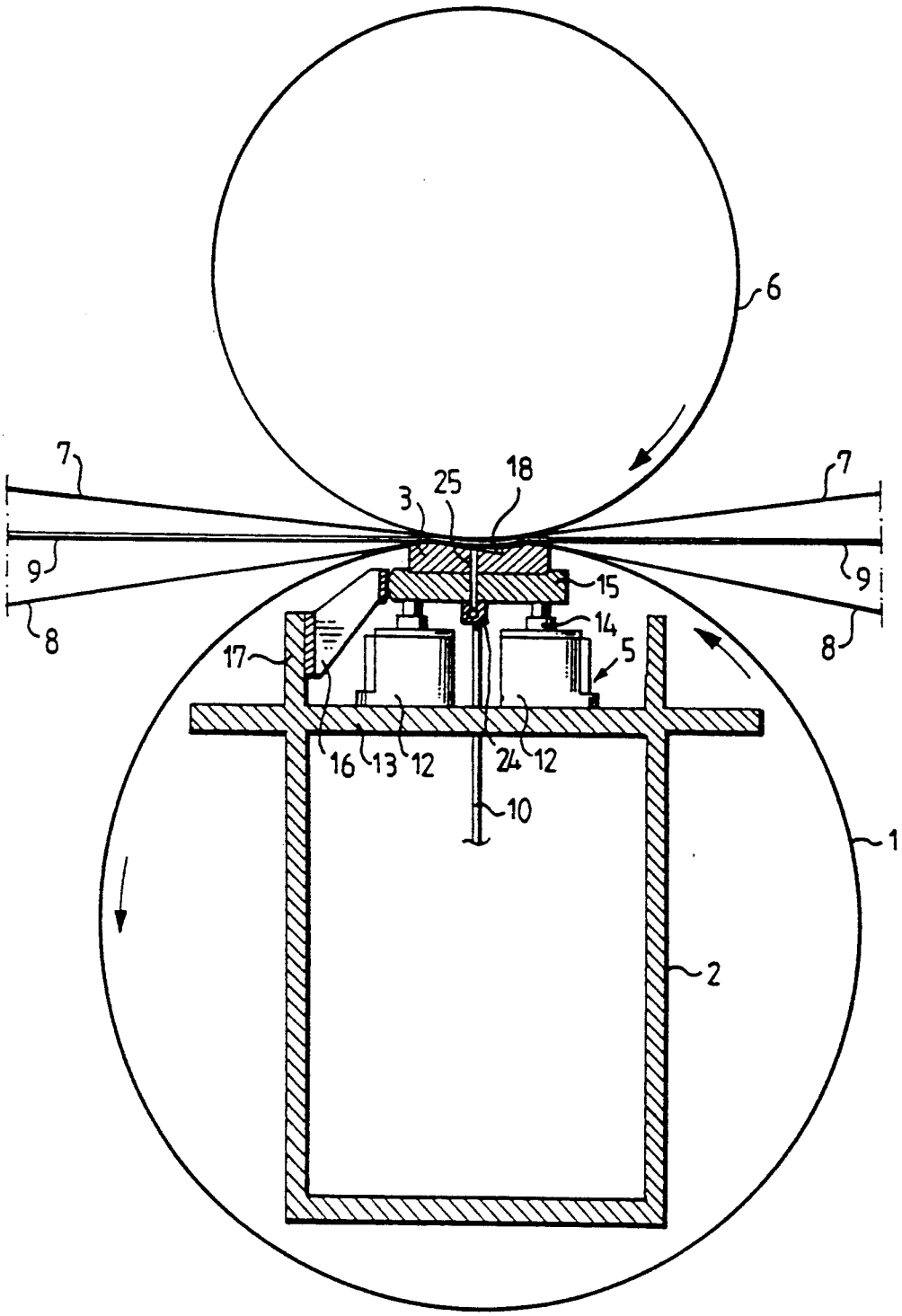
FIG. 1 is a schematic end view of a double-felted wet press with extended nip formed between a counter roll and a shoe press roll, with a press shoe in accordance with the present invention.

The shoe press shown in FIG. 1 comprises an endless, liquid-impermeable flexible belt member 1 which is arranged in known manner to rotate in the direction indicated by an arrow. In the embodiment shown the belt member 1 is in the form of a jacket of a roll and may be mounted in the manner described and shown in SE-B-464 032. The roll jacket 1 may be of conventional design and consist of reinforced polyethylene, for instance. A stationary, non-rotatable support beam 2 extends axially through the flexible jacket 1 and is provided at its ends with shaft pins (not shown) extending through end walls (not shown) and journalled in journalling units (not shown). The jacket 1 is rigidly mounted to said end walls at its opposite edge portions.

Further, the shoe press roll comprises a press shoe 3 having a concave surface portion 4, and hydraulic means 5 to press the concave surface portion 4 of the press shoe 3 against the flexible jacket 1 so that the jacket 1 and a counter roll 6 together form an extended nip in the direction of rotation of the jacket 1. The counter roll 6 is suitably a controlled deflection roll, preferably of the type marketed by Valmet Paper Machinery Inc. under the trademark SYM-Z roll. Two press felts 7, 8 are arranged to run, each in its own loop, over a plurality of rolls (not shown) and through the extended nip. During operation a continuous wet web 9 of paper runs through the extended nip together with the jacket 1 and the press felts 7, 8, said press felts 7, 8 enclosing the web 9 between them in order to receive liquid pressed out of the the web 9 as it passes through the extended nip. The shoe press roll also comprises means 10 for the supply of a liquid lubricant to the surface 11 of the press shoe 3 being in close contact with the flexibel jacket 1, said contact surface 11 comprising said concave surface portion 4. Alternatively the shoe press roll has a single felt.

In the embodiment shown, the hydraulic means 5 for pressing the press shoe 3 against the inner surface of the jacket 1 comprise a plurality of double-acting hydraulic jacks 12 disposed in two parallel rows along and radially inside the leading and trailing edges of the press shoe 3. The jacks 12 are suitably combined in a hydraulic cylinder block of the principle design shown in EP-A1-0 345 500, but the two rows of jacks 12 here have instead been distributed in separate blocks.

The jacks 12 are secured on to the upper side of the top portion 13 of the box-shaped support beam 2 by means of screws (not shown) and have protruding piston rods 14. The press shoe 3 is secured by screws (not shown) to a support plate 15 which is in turn secured by screws (not shown) to some of the piston rods 14. The support plate 15 is at its rear edge formed with a longitudinal rounding which is intended to cooperate with a front edge of a support 16 extending from the upper section of a rear wall part 17 of the support beam 2, forwards towards the support plate 15. Said rounding at the rear edge of the support plate 15 enables support in the machine direction for the press shoe 3 mounted on the support plate 15 even if the jacks 12 in the two rows operate in such a manner that, for instance, the trailing edge of the press shoe is exerted to higher forces than the leading edge. To enable such an exertion of forces the support plate 15 is secured to some of the piston rods 14 with a sufficient play. The other piston rods 14 have spherically rounded ends that rest on the support plate 15 either directly or via spherically rounded bearing cups (not shown).

Figure 2:
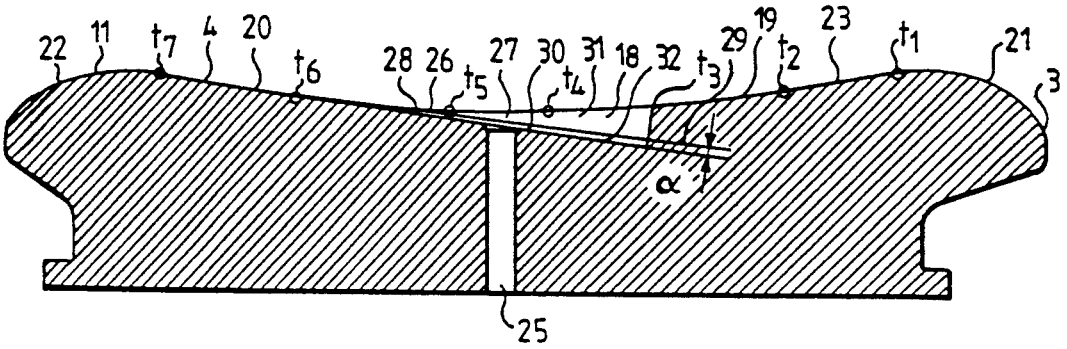
FIG. 2 is a cross section view of the press shoe substantially according to FIG. 1 and showing a pressure pocket according to a preferred embodiment of the invention.

In FIG. 2 the press shoe is shown in cross section to illustrate its various functional sections. The boundaries or common ends are denoted by $t_1,t_2,t_3,t_4,t_5,t_6$ and $t_7$ and are explained in more detail in the following.

Figure 7:
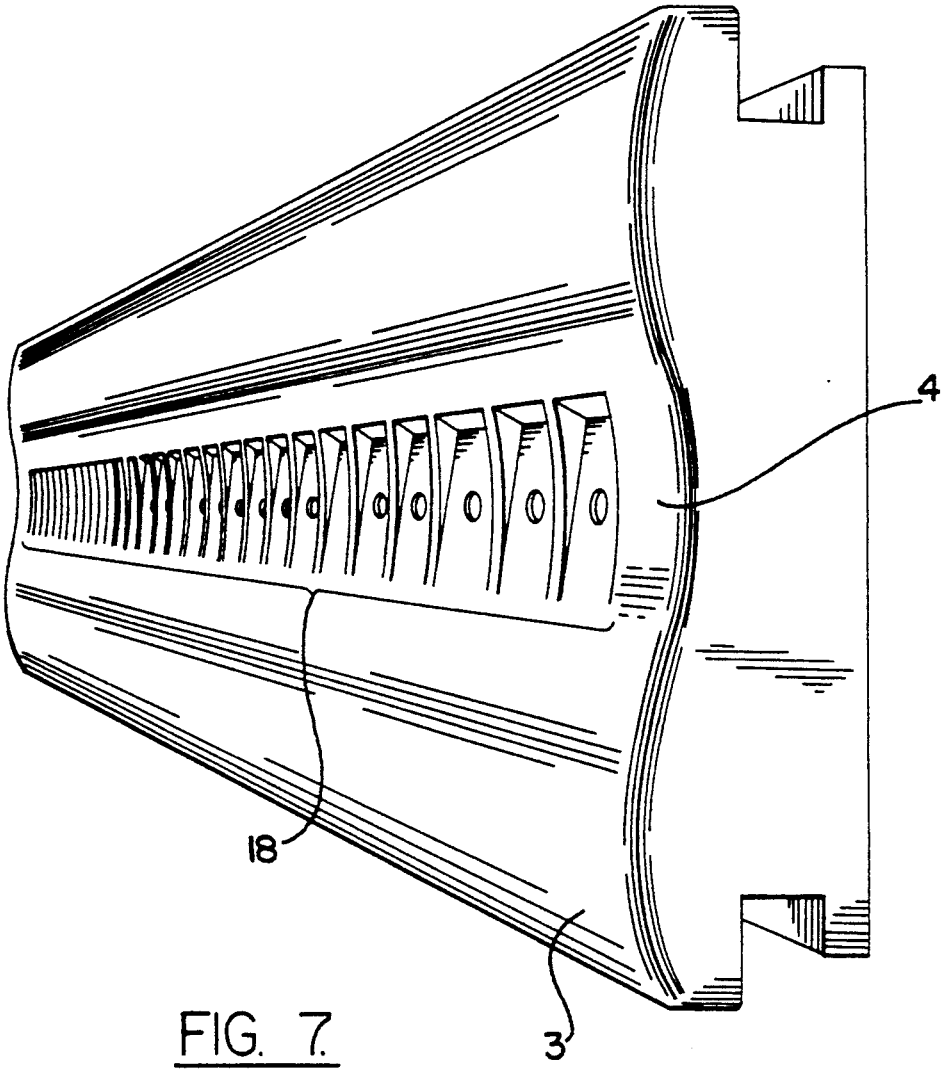
FIG. 7 is an enlarged plan view of one embodiment of the press shoe of the present invention having a plurality of adjacent hydrostatic pressure pockets.

The press shoe 3 is preferably provided with a row of a plurality of adjacent hydrostatic pressure pockets 18, as illustrated in FIG. 7, which are preceded and followed by leading and trailing land surfaces 19, 20 which, in the direction of rotation of the jacket 1, have a width sufficient for the press shoe 3 to be of combined hydrodynamic and hydrostatic type. The forward end $t_2$ of the leading land surface 19 passes tangentially into an inlet surface 21 and the rear end $t_7$ of the trailing land surface 20 passes tangentially into an outlet surface 22. The pressing zone is thus formed by the pressure pockets 18, land surfaces 19, 20 and a plane section 23 of the inlet surface 21 adjacent to the leading land surface 19, commencing at a front end $t_1$.

A supply pipe 24 (see FIG. 1) for the supply of liquid lubricant to the hydrostatic pressure pockets 18 is connected to the lower side of the support plate 15 between the two rows of hydraulic cylinder blocks 12. The lubricant also has a cooling effect on the surfaces of the jacket 1 and press shoe 3, said surfaces being movable in relation to each other. A channel 25 extends from the supply pipe 24 to each pressure pocket 18. Each such channel 25 is provided with a permanent throttle (not shown) which may be in the form of a long axial bore with small diameter through a screw (not shown) inserted in the channel 25, in order to ensure that each pressure pocket 18 receives a predeterminded flow of oil at predetermined pressure.

Each pressure pocket 18 is, according to the present invention, designed in a unique manner so that it comprises a first pocket zone 26, in which a film of lubricant shall be formed so that the hydrodynamic pressure commences already in this first pocket zone 26 of the pressure pocket 18, and a second pocket zone 27 which precedes the first pocket zone 26.

The first pocket zone 26 is wedge-shaped and has a plane bottom surface 28 which is located at gradually decreasing depth from the concave surface section 4 of the press shoe 3 seen in the direction of rotation of the jacket 1, said depth being zero at the rear end $t_6$ of the pressure pocket 18. The forward end $t_5$ of the bottom surface 28 of the first pocket zone 26 has a depth of 0.2–0.8 mm, preferably 0.5–0.7 mm, from the concave surface section 4 of the press shoe 3. In the embodiment shown the bottom surface 28 forms an angle $\alpha$ of about 1° with a tangent 29 to the concave surface section 4 of the press shoe 3 at the trailing end $t_6$ of the pressure pocket 18. In general this angle $\alpha$ may be from 0° to about 2°. When the angle $\alpha$ is 0°, therefore, the bottom surface 28 coincides with said tangent 29 and when the angle $\alpha$ is greater than 0°, up to about 2°, the bottom surface intersects the tangent point which thus corresponds to the trailing end $t_6$ of the pressure pocket 18.

The second pocket zone 27 has a plane bottom surface 30, which in the embodiment shown in FIG. 2, is in the same plane as the bottom surface 28 of the first pocket zone 26. In general the second pocket zone 27 forms an angle $\alpha$ of from 0° as in the embodiment shown in FIG. 2, to about ±10° with said plane coinciding with the bottom surface 28 of the first pocket zone 26. The function of the second pocket zone 27 is to provide as smooth a transition as possible to the first pocket zone 26 so that no (0°) or very little deflection point $t_5$ (10°) is formed. Since the bottom surfaces 28, 30 in the embodiment shown in FIG. 2 coincide with each other in one and the same plane there is no visible boundary between them, said boundary being designated $t_5$. The position of this imaginary boundary $t_5$, i.e. the point at which a film starts to be formed, varies dependent on various operating parameters, for a given value of the angle $\alpha$. These parameters include primarly the speed of the jacket 1 and the viscosity of the lubricant. The depth of the pressure pocket 18 at the boundary $t_5$ thus corresponds to the thickness of the film that can be formed at this boundary at a specific jacket speed and specific viscosity of the lubricant. If these parameters are changed the thickness of the film that can be formed will change so that the boundary $t_5$ is shifted to a new position to the left or right of the position shown in FIG. 2.

Figure 3:
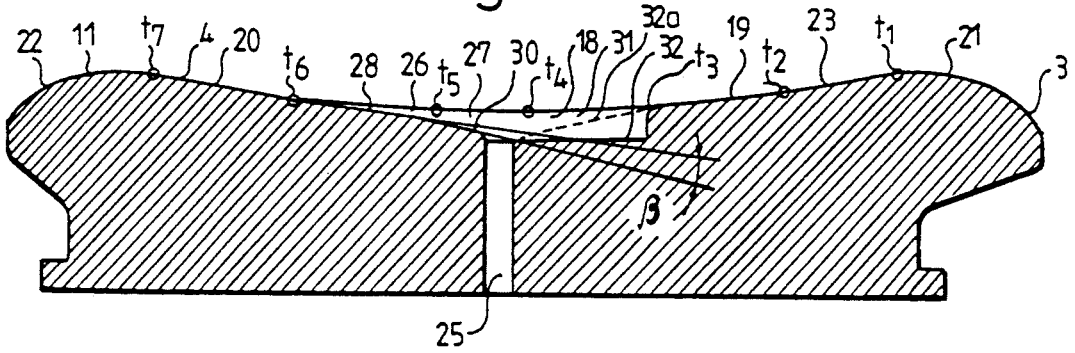
FIG. 3 is a cross section view of a press shoe of the same basic design as that shown in FIG. 2, but with a pressure pocket according to a second embodiment of the invention.
Figure 4:
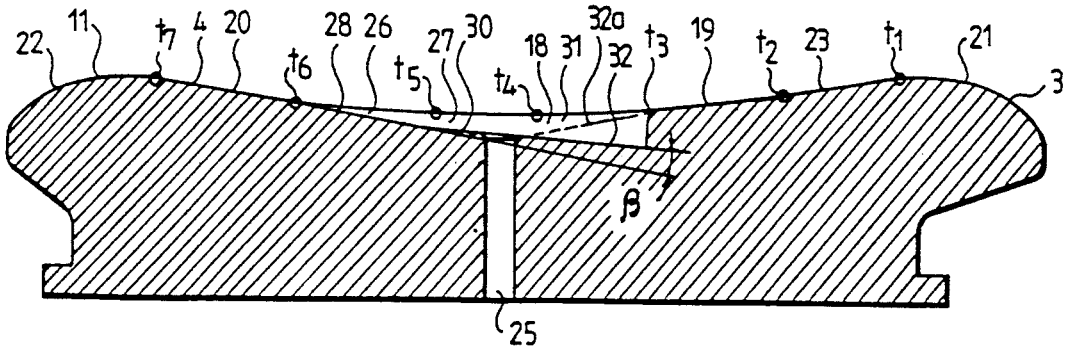
FIG. 4 is a cross section view of a press shoe of the same basic design as that shown in FIG. 2, but with a pressure pocket according to a third embodiment of the invention.

In the embodiments according to FIGS. 3 and 4 the second pocket zone 27 comprises a plane bottom surface 30 that forms an angle $\beta$ of at most 10° with the plane coinciding with the bottom surface 28 of the first pocket zone 26. The bottom surface 30 is then located below (FIG. 3) or above (FIG. 4) this plane. In both cases the boundary $t_5$ is assumed to lie at the transition between the two bottom surfaces 28, 30. However, it will be understood that this boundary for the formation of a film of lubricant may vary in this case also, if said operating parameters are changed so that the boundary $t_5$ lies to the right or the left of the point indicated. The first pocket zone 26 may therefore also include a plane bottom surface forming said angle $\beta$ with a plane coinciding with the bottom surface 28, or the bottom surface of the first pocket zone 26 may constitute a part of the shown bottom surface 28.

The combined length of the first and second pocket zones 26, 27 calculated in the direction of rotation of the jacket 1 is suitably 8–60 mm, preferably 20–40 mm. At the forward end $t_4$ of the second pocket zone 27 the pressure pocket 18 has a depth of 0.3–1.8 mm, preferably 1.4–1.7 mm, in order to ensure hydrostatic pressure in the pressure pocket. The second pocket zone 27 may constitute a major portion of the pressure pocket 18 and, depending on the length of the pressure pocket, the forward end $t_4$ of the second pocket zone may coincide with the leading end $t_3$ of the pressure pocket 18.

In the embodiments shown in FIGS. 2 to 4 the pressure pocket 18 also comprises a third pocket zone 31 having a bottom surface 32 that may be designed in various ways as illustrated by both unbroken and broken lines 32*a*. The embodiment according to FIG. 2 is particularly advantageous from the manufacturing point of view since the cutting tool need only be set in a single machining position in order to produce the finished pressure pocket 18. The depth of the pressure pocket at the leading end $t_3$ may be from zero up to several millimeters, e.g. 2–10 mm.

The press shoe suitably consists of a metallic material having better heat dissipation properties and being easier to work than steel. A particularly suitable metallic material is an aluminium alloy.

Figure 5:
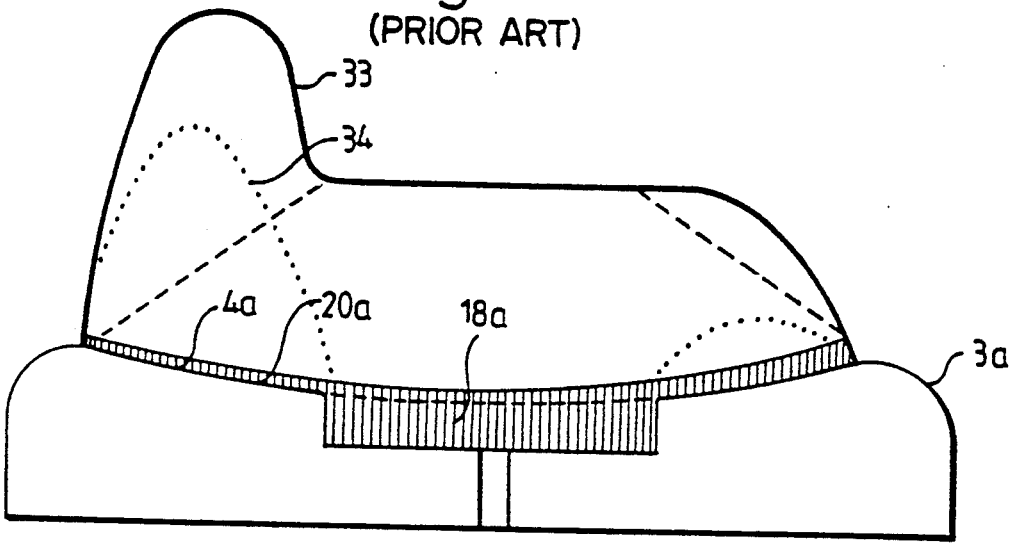
Fig. 5 (PRIOR ART)
FIG. 5 is a diagram illustrating the variation in nip pressure along a press shoe having a hydrostatic pressure pocket of conventional form.
Figure 6:
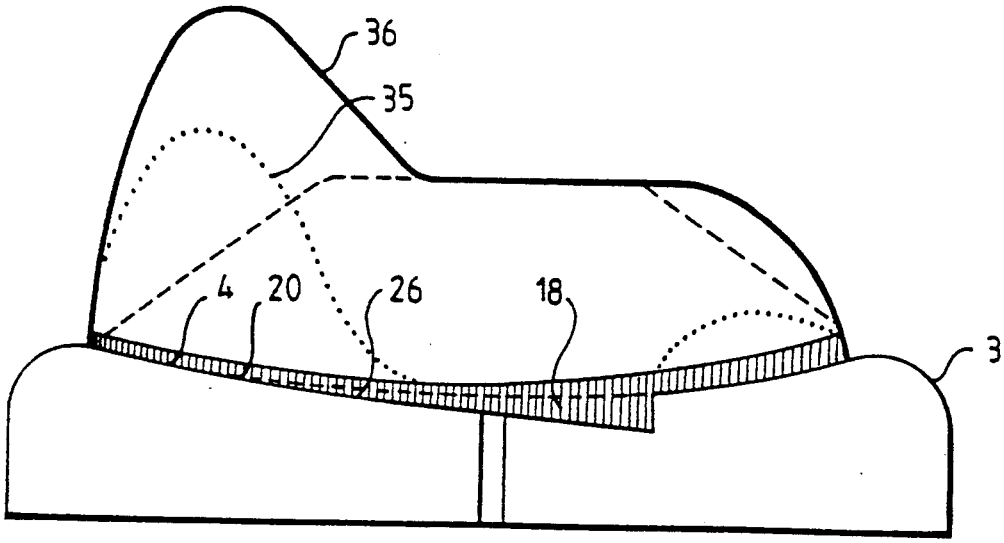
FIG. 6 is a diagram illustrating the variation in nip pressure along a press shoe having a hydrostatic pressure pocket substantially in accordance with the embodiment shown in FIG. 2.

In FIGS. 5 and 6 the unbroken lines indicate the nip pressure profiles that are the sum of the hydrostatic pressure according to the broken lines and the hydrodynamic pressure according to the dotted lines. The datched areas indicate the liquid lubricant under pressure.

FIG. 5 shows the nip pressure, profile obtained at a specific loading of the leading edge and trailing edge of a known press shoe 3*a* having a pressure pocket 18 with substantially constant depth from the concave surface portion 4*a* of the press shoe 3*a*. Due to the steep transition between the pressure pocket 3*a* and the trailing land surface 20*a*, a hydrodynamic pressure is produced very quickly at the trailing end of the pressure pocket 18*a* so that the nip pressure increases very rapidly, as illustrated by the pressure profile portion designated 33. The designation 34 indicates the curve for the hydrodynamic pressure within the trailing land surface 20*a*.

FIG. 6 shows the nip pressure profile obtained at the same loading as above of the leading edge and trailing edge of a press shoe 3 having a pressure pocket 18 designed in accordance with the present invention and substantially in accordance with the embodiment shown in FIG. 2. As illustrated by the curve 35, the hydrodynamic pressure is built up already within the rear pocket part 26 of the pressure pocket 18 and with a more flattened rising than is the case for the known press shoe 3*a*. The nip pressure thus increases more slowly, as illustrated by the pressure profile portion designated 36, and this increase from a constant nip pressure condition commences already within the region of the pressure pocket 18. The nip pressure profile consequently approaches the ideal pressure curve shape.

That which is claimed is:

1. An extended nip press comprising (a) a continuous, rotatable, liquid-impermeable, flexible belt member;

(b) a stationary, non-rotatable support beam extending axially through said endless belt member;

(c) a press shoe adjustably supported by said support beam and having a concave surface portion;

(d) hydraulic means to press said concave surface portion of the press shoe against said belt member so that the belt member and a counter roll together form an extended nip in the direction of rotation of the belt member;

(e) means for the supply of a liquid lubricant to a surface of the press shoe being in close contact with the belt member;

(f) said press shoe having one or more hydrostatic pressure pockets, each of which is preceded and followed by a leading land surface and a trailing land surface, respectively, and wherein each pocket has a leading end and a trailing end;

(g) said means for the supply of lubricant comprising a channel opening into said hydrostatic pressure pocket in order to supply lubricant under pressure into the hydrostatic pressure pocket;

(h) said land surfaces having a dimension in the direction of rotation of the belt member that is sufficient for said press shoe to be of combined hydrostatic and hydrodynamic type;

(i) said pressure pocket having a first wedge-shaped pocket zone in which a hydrodynamic pressure shall be created and which comprises a plane bottom surface located at gradually decreasing depth from said concave surface portion of the press shoe seen in the direction of rotation of said belt member, said depth being zero at the trailing end of said pressure pocket, said plane bottom surface forming an angle $\alpha$ of from 0° to about 2° with a tangent to said concave surface portion of the press shoe at the trailing end of the pressure pocket; and (j) said first pocket zone being preceded by a second pocket zone comprising a plane bottom surface forming an angle $\beta$ of from 0° to about $\pm 10°$ with a plane that coincides with said plane bottom surface of the first pocket zone.

2. An extended nip press as recited in claim 1, wherein the forward end of said bottom surface of the first pocket zone is located at a depth of 0.2–0.08 mm from said concave surface portion of the press shoe.

3. An extended nip press as recited in claim 2, wherein the forward end of said bottom surface of said first pocket zone is located at a depth of 0.5–0.7 mm from said concave surface portion of the press shoe.

4. An extended nip press as recited in claim 1, wherein the forward end of said bottom surface of the second pocket zone is located at a depth of 0.3–1.8 mm from said concave surface portion of the press shoe.

5. An extended nip press as recited in claim 4, wherein the forward end of said bottom surface of said second pocket zone is located at a depth of 1.4–1.7 mm from said concave surface portion of the press shoe.

6. An extended nip press as recited in claim 1, wherein said bottom surfaces of said two pocket zones are located in the same plane, and that the second pocket zone forms a major part of the pressure pocket and extends from the leading end of the pressure pocket.

7. An extended nip press as recited in claim 1, wherein the combined length of the first and second pocket zones calculated in the direction of rotation of said belt member is 8–60 mm.

8. An extended nip press as recited in claim 6, wherein the combined length of the first and second pocket zones calculated in the direction of rotation of said belt member is 20–40 mm.

9. An extended nip press as recited in claim 1, wherein said press shoe has a plurality of identical hydrostatic pressure pockets located transversely beside each other.

10. An extended nip press as recited in claim 1, wherein said press shoe consists of a metallic material having better heat dissipation properties and is easier to machine than steel.

11. An extended nip press as recited in claim 10, wherein said metallic material is an aluminum alloy.

12. An extended nip press comprising (a) a continuous, rotatable, liquid-impermeable, flexible belt member;

(b) a stationary, non-rotatable support beam extending axially through said endless belt member;

(c) a press shoe adjustably supported by said support beam and having a concave surface portion;

(d) a hydraulic means to press said concave surface portion of the press shoe against said belt member so that the belt member and a counter roll together form an extended nip in the direction of rotation of the belt member;

(e) means for the supply of a liquid lubricant to a surface of the press shoe being in close contact with the belt member;

(f) said press shoe having one or more hydrostatic pressure pockets, each of which is preceded and followed by a leading land surface and a trailing land surface, respectively, and wherein each pocket has a leading end and a trailing end;

(g) said means for the supply of lubricant comprising a channel opening into said hydrostatic pressure into the hydrostatic pressure pocket;

(h) said land surfaces having a dimension in the direction of rotation of the belt member that is sufficient for said press shoe to be of combined hydrostatic and hydrodynamic type;

(i) said pressure pocket having a plane bottom surface located at gradually decreasing depth from said concave surface portion of the press shoe seen in the direction of rotation of said belt member, said depth being zero at the trailing end of the pressure pocket; and (j) said bottom surface of the pressure pocket forming an angle $\alpha$ of from 0° to about 2° with a tangent to said concave surface portion of the press shoe at the trailing end of the pressure pocket so that a hydrodynamic pressure is produced in a rear, wedge-shaped pocket zone thus formed.

* * * * *

UNITED STATES PATENT AND TRADEMARK OFFICE

CERTIFICATE OF CORRECTION

PATENT NO. : 5,262,011

DATED : November 16, 1993

INVENTOR(S) : Antti I. Ilmarinen

It is certified that error appears in the above-identified patent and that said Letters Patent is hereby corrected as shown below:

Column 7, line 14, "0.2-0.08" should be -- 0.2-0.8 --.

Column 7, line 38, "claim 6" should be -- claim 7 --.

Signed and Sealed this

Nineteenth Day of April, 1994

Bruce Lehman

*Attest:*

BRUCE LEHMAN

*Attesting Officer*

*Commissioner of Patents and Trademarks*